US010867553B2

(12) United States Patent
Tseng et al.

(10) Patent No.: US 10,867,553 B2
(45) Date of Patent: Dec. 15, 2020

(54) ELECTRONIC DEVICE CAPABLE OF REDUCING COLOR SHIFT OR INCREASING LUMINOUS EFFICACY

(71) Applicant: InnoLux Corporation, Miao-Li County (TW)

(72) Inventors: Ming-Chun Tseng, Miao-Li County (TW); Chin-Lung Ting, Miao-Li County (TW); Li-Wei Mao, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/362,683

(22) Filed: Mar. 24, 2019

(65) Prior Publication Data

US 2019/0325825 A1 Oct. 24, 2019

Related U.S. Application Data

(60) Provisional application No. 62/660,206, filed on Apr. 19, 2018.

(30) Foreign Application Priority Data

Sep. 26, 2018 (CN) ..... 2018 1 1126487

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0861* (2013.01); *G09G 2320/0626* (2013.01)

(58) Field of Classification Search
CPC ..... G09G 3/3233; G09G 3/3291; G09G 2300/0842; G09G 2300/0861; G09G 2320/0242; G09G 2320/0626; G09G 3/2014; G09G 3/2022
See application file for complete search history.

(56) References Cited

U.S. PATENT DOCUMENTS

| | | | | |
|---|---|---|---|---|
| 8,497,885 | B2 | 7/2013 | Ikeda | |
| 2006/0152452 | A1 | 7/2006 | Hoppenbrouwers | |
| 2008/0018632 | A1 | 1/2008 | Cordes | |
| 2008/0036371 | A1 | 2/2008 | Kim | |
| 2009/0289966 | A1* | 11/2009 | Ikeda | G09G 3/2018 345/690 |
| 2014/0375679 | A1 | 12/2014 | Margolis | |
| 2017/0047003 | A1* | 2/2017 | Kim | G09G 3/3233 |
| 2018/0053460 | A1 | 2/2018 | Watsuda | |
| 2018/0061327 | A1* | 3/2018 | Hong | G09G 3/3275 |

FOREIGN PATENT DOCUMENTS

| | | | |
|---|---|---|---|
| CN | 1816839 | A | 8/2006 |
| CN | 1985294 | A | 6/2007 |
| CN | 101779229 | A | 7/2010 |
| CN | 105359540 | A | 2/2016 |

* cited by examiner

*Primary Examiner* — Nelson M Rosario
(74) *Attorney, Agent, or Firm* — Winston Hsu

(57) ABSTRACT

An electronic device includes an electronic unit including a light emitting diode (LED) and a driving unit coupled to the light emitting diode for receiving a data voltage. The electronic unit has a plurality of driving periods in a frame period, and the driving unit drives the LED according to the data voltage in the plurality of driving periods.

18 Claims, 9 Drawing Sheets

ELECTRONIC DEVICE CAPABLE OF REDUCING COLOR SHIFT OR INCREASING LUMINOUS EFFICACY

CROSS REFERENCE TO RELATED APPLICATION

This application claims the benefit of U.S. Provisional Patent Application No. 62/660,206, filed 2018 Apr. 19, and included herein by reference.

BACKGROUND OF THE DISCLOSURE

1. Field of the Disclosure

The present disclosure relates to an electronic device, and more particularly to an electronic device that can reduce color shift or increase luminous efficacy.

2. Description of the Prior Art

In the prior art, an active matrix light-emitting diode display can drive the light-emitting diode (LED) by regulating the current, so that the LED emits light with different brightness. However, the light emitted by the LED is prone to color shift as the current changes, which seriously affects the picture quality. Therefore, the present disclosure proposes an electronic device capable of reducing color shift or increasing luminous efficacy.

SUMMARY OF THE DISCLOSURE

An embodiment provides an electronic device comprising an electronic unit comprising a light emitting diode (LED) and a driving unit coupled to the light emitting diode for receiving a first data voltage. The electronic unit has a plurality of driving periods in a frame period, and the driving unit drives the LED according to the first data voltage in the plurality of driving periods.

These and other objectives of the present disclosure will no doubt become obvious to those of ordinary skill in the art after reading the following detailed description of the embodiment that is illustrated in the various figures and drawings.

DETAILED DESCRIPTION

In this description, the terms "generally" and "roughly" mean within 20%, 10% or 5% of a given value or range. The quantity given here is an approximate quantity, meaning that "generally" and "roughly" may be implied without specific explanation.

Figure 1:
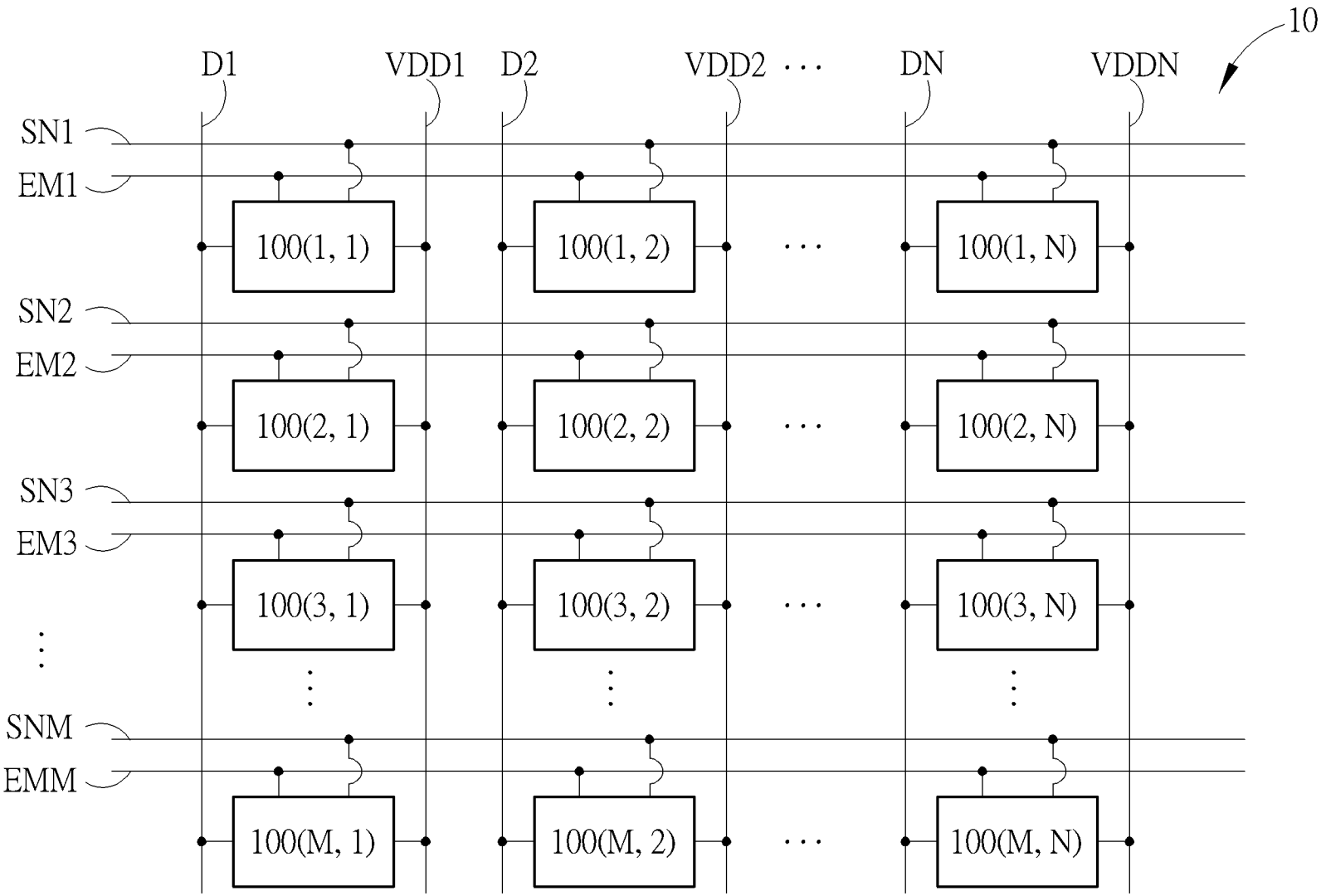
FIG. 1 is a diagram of an electronic device according to an embodiment of the present disclosure.

FIG. 1 is a diagram of an electronic device 10 according to an embodiment of the present disclosure. The electronic device 10 may comprise a plurality of electronic units 100(1, 1) to 100(M, N), M and N being positive integers equal to or greater than 2. In some embodiments, the electronic units 100(1, 1) to 100(M, N) may be arranged in an array. In FIG. 1, the electronic units 100(1, 1) to 100(1, N) may be disposed in the same row, and the electronic units 100(1, 1) to 100(M, 1) can be disposed in the same column. The first positive integer in the parentheses marked corresponds to the row, and the second positive integer in the parentheses corresponds to the column.

Figure 2:
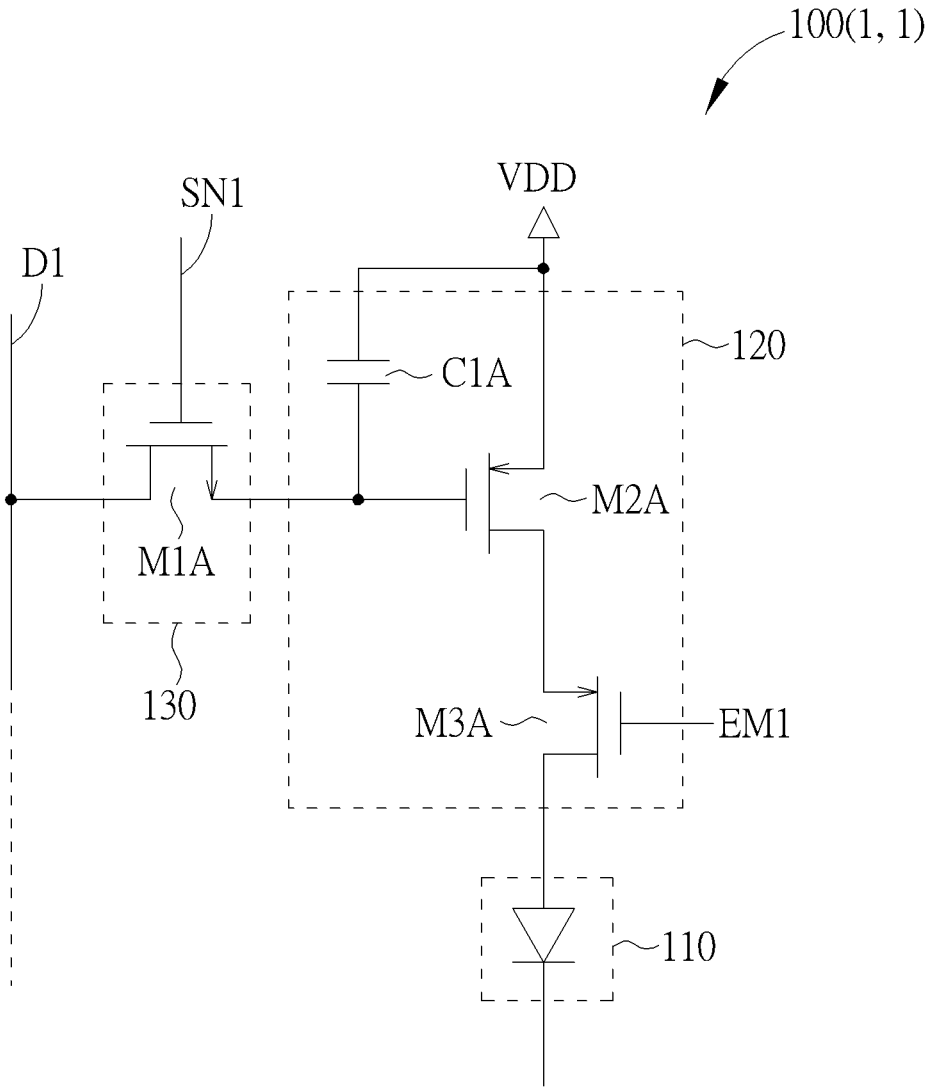
FIG. 2 is a circuit diagram of an electronic unit of the electronic device in FIG. 1.

FIG. 2 is a circuit diagram of the electronic unit 100(1, 1) according to an embodiment. In some embodiments, the electronic units 100(1, 1) to 100(M, N) may have the same or different circuit configurations. In FIG. 2, the electronic unit 100(1, 1) may comprise a light emitting diode (LED) 110, a driving unit 120, and a switch unit 130. The driving unit 120 can be coupled to the LED 110, and the switch unit 130 can be coupled to the driving unit 120. If two elements are referred as coupled, they may include two elements that are electrically connected directly or are connected to each other through other elements. In one frame period of the electronic unit 100(1, 1), storage of the data voltage is performed first. For example, when the switch unit 130 of the electronic unit 100(1, 1) is turned on, the driving unit 120 can receive the data voltage transmitted by the data line D1. The data voltage is first stored in the capacitor of the driving unit 120, and then the driving unit 120 can generate a corresponding amount of current according to the data voltage to drive the LED 110. Subsequently, the LED 110 may emit the corresponding brightness. The LED 110 may include a micro-LED, a mini-LED, an organic light-emitting diode (OLED) or other suitable light-emitting diode component, but not limited thereto. In some embodiments, the LED 110 may include a quantum dot (QD) material, a fluorescent material, a phosphor material, or other suitable light converting material, but it is not limited. The electronic device 10 may include a display device, a light emitting device, a sensing device, or other suitable device, but it is not limited. In some embodiments, the electronic device 10 can be applied to a tiled device.

In some embodiments, as shown in FIG. 2, the switch unit 130 may comprise a transistor M1A (e.g., a switching transistor). The driving unit 120 may comprise a transistor M2A (e.g., a driving transistor), a capacitor C1A, and a transistor M3A (e.g., a control transistor), but is not limited thereto. The transistor M1A is coupled to the scan line SN1 and the data line D1. When data voltage is stored, a scan voltage is transmitted through the scan line SN1 to turn on the transistor M1A, so that the capacitor CIA can store the data voltage transmitted by the data line D1. The "storage of the data voltage" process enables the transistor M2A to generate a current according to the data voltage in the subsequent driving period, and the transistor M2A may drive the LED or control the brightness of the emitted light by the amount of current flowing through the LED. In some embodiments, the transistor M3A can be coupled to an emission control line EM1 to control the turning on or the turning off of the transistor M3A through supplying a control voltage transmitted by the emission control line EM1. The emission control line EM1 supplies a control voltage to turn on the transistor M3A in the driving period, and the emission control line EM1 turns off the transistor M3A in other periods (for example, an interval other than the driving period), thereby adjusting the time interval of the driving period or the amount of current flowing through the LED to regulate the brightness of light emitted by the LED. It should be noted that, although the driving unit 120 of the present disclosure only shows the transistor M2A, the capacitor CIA and the transistor M3A, but in other embodiments, the driving unit 120 may comprise other transistors, capacitors or other circuit components. For example, the driving unit 120 may include a compensation transistor, a reset transistor, but it is not limited. In some embodiment, the electronic unit 100(1, 1) may comprise a plurality of LEDs 110. It should be noted that, although the transistor of the present disclosure only shows a three-terminal transistor (a gate terminals, a drain terminals and a source terminal), but in other embodiments, some transistors may include a four-terminal transistor (two gate terminals, a drain terminal and a source terminal).

In the embodiment of FIG. 1, the electronic device 10 may sequentially turn on the electronic units from the first to the Mth row. In detail, the scan lines of the first row to the Mth row sequentially transmit the scan voltage to the coupled electronic units, and turn on the corresponding switch units. At this time, the electronic units transmit the data voltage through the respectively coupled data lines. The data voltage may be stored in the capacitor of the driving unit to complete a step of storage the data voltage. In some embodiments, the electronic units corresponding to the same row (such as the electronic units 100(1, 1) to 100(1, N)) are coupled to the scan line SN1, and the electronic units 100(2, 1) to 100(2, N) are coupled to the scan line SN2. So the electronic units 100(M, 1) to 100(M, N) are coupled to the scan line SNM. In addition, in some embodiments, the electronic units 100(1, 1) to 100(1, N) are coupled to the emission control line EM1, and the electronic units 100(2, 1) to 100(2, N) are coupled to the emission control line EM2 and so on. So the electronic units 100(M, 1) to 100(M, N) are coupled to the emission control line EMM, but not limited thereto. In some embodiments, the emission control line EM1 to the emission control line EMM may control the corresponding the electronic units, and the emission control line EM1 to the emission control line EMM are coupled to different control terminals respectively. The control terminal may include a Gate on Panel (GOP) or an integrated circuit (IC), but not limited thereto. In some embodiments, the electronic units in the same column (such as electronic units 100(1, 1) to 100(M, 1)) are coupled to the data line D1, and the electronic units 100(1, 2) to 100(M, 2) are coupled to the data line D2, and so on. The electronic units 100(1, N) to 100(M, N) are coupled to the data line DN, but not limited thereto. After the data voltage of the electronic units 100(1, 1) to 100(1, N) are stored, the electronic device 10 can start to storage the data voltage in the electronic units 100 (2, 1) to 100 (2, N) and so on, but not limited thereto. The manner of coupling the scan lines, the data lines or emission control lines to the electronic units in different columns or different rows is only an example, which may be changed according to application. For example, an emission control line may be coupled to electronic units coupled to the same column, and an extension direction of the emission control line can be parallel with an extension direction of the data line.

Figure 3:
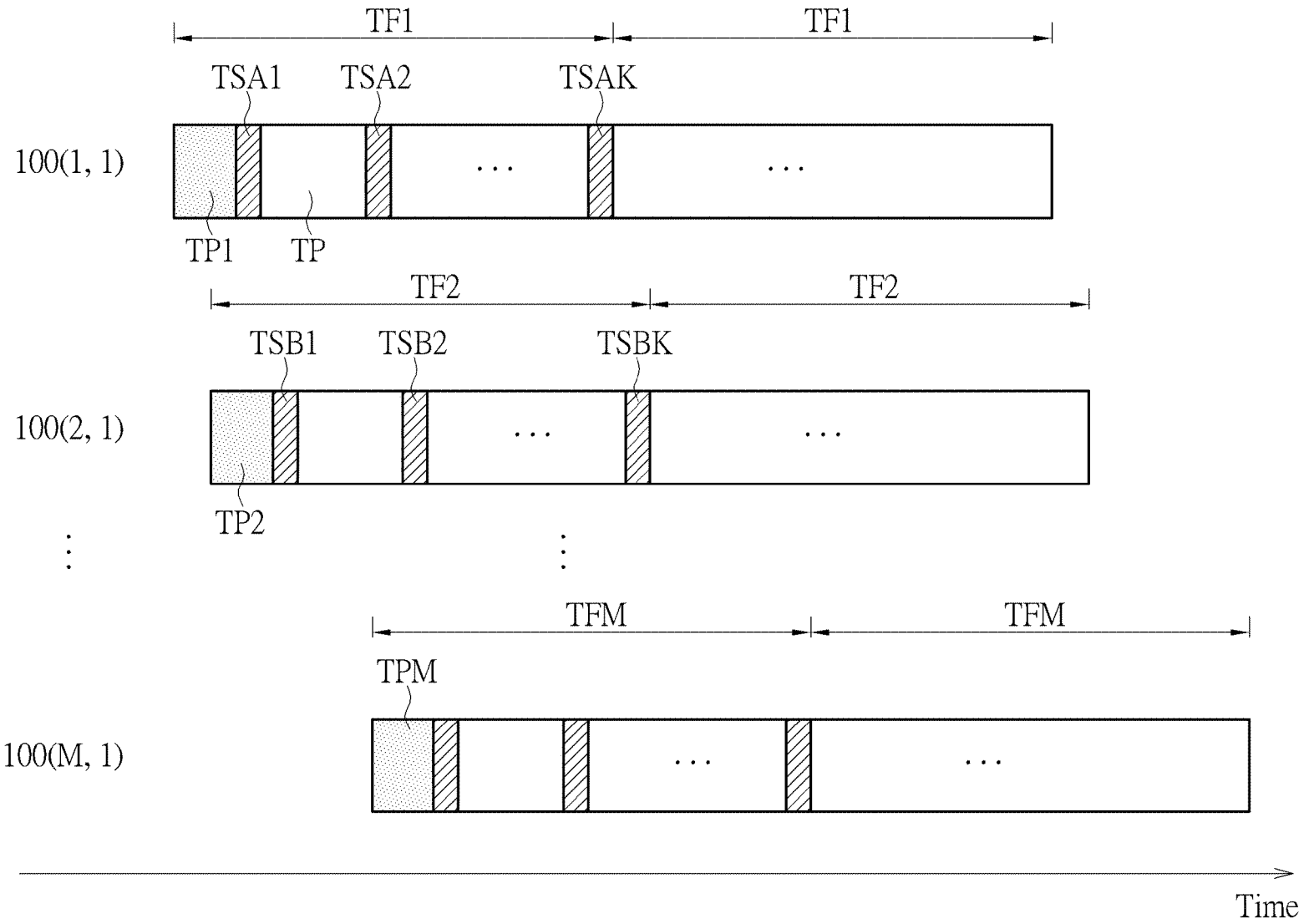
FIG. 3 shows an operation sequence of the first column of electronic units of the electronic device in FIG. 1.

FIG. 3 shows an operation sequence of the electronic units 100(1, 1) to 100(M, 1) of the electronic device 10. In FIG. 3, the electronic units 100(1, 1) to 100(M, 1) perform a step of storage of the data voltages in the time period TP1 to the time period TPM. In a frame period TF1, the driving unit 120 of the electronic unit 100(1, 1) receives the corresponding data voltage in the time period TP1, and completes the data storage. In the subsequent plurality of driving periods (for example, driving periods TSA1 to TSAK), corresponding currents may be respectively generated according to the data voltage to drive the LED 110 of the electronic unit 100(1, 1), wherein K is an integer equal to or greater than 1. In the frame period TF1, the driving unit 120 can drive the LED 110 K times. That is, the LED 110 may emit light K times. According to the above method, since the number of times of light emission by the LED 110 increases, it is difficult for the human eye to perceive flickers. In FIG. 3, in a frame period TF2 of the electronic unit 100(2, 1), the driving unit 120 receives the corresponding data voltage in the period TP2, and completes the storage of the data voltages. In a subsequent plurality driving periods TSB1 to TSBK, corresponding currents may be respectively generated according to the data voltages to drive the LED 110 of the electronic unit 100(2, 1). The electronic unit 100(M, 1) may work in the similar manner. In FIG. 3, the frame period TF1 and the frame period TF2 (and/or the frame period TFM) correspond to the same picture frame, and the respective starting times of the plurality of driving periods TSA1 to TSAK in the frame period TF1 may be different from that in the frame period TF2. In other words, the starting times of light emission for the LEDs 110 in the electronic units of the first row and the starting times of light emission for the LEDs 110 of the second row are different. With the aforementioned method, the electronic units of the first row and the electronic units of the second row (or other rows of electronic units) can flow the currents through the coupled LEDs in batches. It can reduce the current flowing simultaneously through the LEDs coupled to the electronic units of the same column (and different rows) at the same starting time, which can reduce the current loading. It should be noted that, in the embodiment of FIG. 3, the electronic units of adjacent columns generally emit light at different starting times, but not limited thereto. It should be noted that, in some embodiments, the starting time of the driving period TSA1 in the frame period TF1 may be different from the first one of the plurality of driving periods in the frame periods TF2 to TFM (e.g. the starting time of the driving period TSB1). The starting time of the drive period TSAK in the frame period TF1 may be the same as one of the starting time of the driving periods TSB1 to TSBK in the frame period TF2, but it not limited.

By the driving method shown in FIG. 3, the sum of the time intervals of the driving periods TSA1 to TSAK may be less than the time interval of the frame period TF1. In some embodiments, the ratio of the sum of the time intervals of the driving periods TSA1 to TSAK to the time interval of the frame period TF1 may be less than or equal to ⅛, but not limited thereto. In this case, in order to make the LED 110 to emit light with the same brightness, the driving unit 120 will generate a larger current to drive the LED 110, the current may be increased by 8 times, but not limited thereto. For example, in a conventional electronic device, the LED 110 may be continuously driven with a current of 50 microamperes (pA) in one frame period. The aforementioned "continuously" means that the LED 110 may be turned on continuously in one frame period. It means that the duty ratio is 1. For the detailed definition of duty ratio, please refer to the following description. In an embodiment of the present disclosure, the ratio of the sum of the time intervals of the driving periods TSA1 to TSAK to the time interval of the frame period TF1 is designed to be ⅛ (i.e., the duty ratio is ⅛). Then the driving unit 120 generates a current of approximately 400 μA (0.4 mA=50 μA×8=400

μA) to drive the LED 110. Since the LED 110 of the above design is driven by a relatively large current, the problem of color shift of the LED 110 with the amount of the current can be reduced, thereby increasing the quality of the electronic device 10. Moreover, according to the characteristics of the LED 110, when the driving current is increased from the microampere level to the milliampere level, the luminous efficacy of the LED 110 can be increased. So in the above embodiment, the driving unit 120 may generate a current of less than 400 μA to drive the LED 110 for emitting light of the corresponding brightness, but not limited thereto. By reducing the time interval of the light-emitting time of the LED 110 in the frame period, the problem of color shift with varying driving current can be reduced. In addition, since the driving current is increased, the luminous efficacy of the LED 110 can be increased, thereby reducing the power loss of the electronic device.

In addition, since the LEDs 110 emitting different color light have different luminous efficacy characteristics or different color shifting characteristics, the LEDs 110 of different color light can be driven with different amount of currents according to their requirements. The driving unit 120 can have different number of transistors corresponding to different colors. The aforementioned color shift characteristic may be chromaticity shift occurs due to the varying current amounts flowing through the LED. In an embodiment, the number of transistors in the red light LED driving unit 120 is greater than the number of transistors in the green light LED driving unit 120. In some embodiments, the number of transistors in the LED driving unit 120 emitted the green light is greater than the number of transistors in the LED driving unit 120 emitted the blue light. In addition, the amount of current may be adjusted by controlling the time interval of the driving period in the aforementioned frame period. When the driving period has greater the time interval, the accumulated current may be larger, but not limited thereto. Therefore, in some embodiments, the sum of the time intervals of the driving periods of the electronic units with different color light in one frame period may be different, but it not limited thereto. For example, the LED 110 in the electronic unit 100(1, 1) can emit blue light or green light, and the LED 110 in the electronic unit 100(2, 1) can emit red light. Since the LED emitting red light may be suitable to be driven with a small current, the sum of the time interval of the driving periods TSB1 to TSBK in the frame period TF2 should be greater than the sum of the time interval of driving periods TSA1 to TSAK in the frame period TF1, but not limited thereto. In some embodiments, the sum of the time interval of the driving periods TSA1 to TSAK in the frame period TF1 is the same or different from the time interval of the driving periods TSB1 to TSBK in the frame period TF2.

In addition, since correlation curves of luminous efficacy to current for the LEDs emitted the blue light and/or the green light may be similar, in some embodiments, the sum of the time intervals of the driving periods of the electronic unit emitted the blue and the green light may be equal to or less than the sum of the time intervals of the driving periods of the electronic units emitted the red light, but not limited thereto. According to other embodiments, a sum of the time intervals of the driving periods of the light LED emitted red light may be equal to or not equal to the sum of the time intervals of the driving periods of the LED emitted the blue light (and/or the LED emitted the green light). According to other embodiments, the sum of the time intervals of the driving periods of the LED emitted the red light, blue light and/or green light LED may be different from each other.

In FIG. 3, the driving periods TSA1 to TSAK in the frame period TF1 may generally have equal time intervals. The time interval between two adjacent driving periods in the driving periods TSA1 to TSAK may be equal to the time interval between another two adjacent driving periods, but not limited thereto. In other embodiments, the time interval between two of the adjacent driving periods in the driving periods TSA1 to TSAK in the frame period TF1 is different from the time interval between another two adjacent driving periods. The aforementioned time interval may exclude the period TP, which may be defined by a time period which no current flowing through the LED 110. In other embodiments, at least two of the driving periods TSA1 to TSAK in the frame period TF1 may have different time intervals, and the two different time intervals may be two adjacent driving periods or two driving periods that are not adjacent. It should be noted that, though only three driving periods TSA1, TSA2, and TSAK are shown in the frame period TF1, the embodiment is not limited thereto. In some embodiments, the frame period TF1 may have two driving periods (i.e., K is 2) for the same reason, the number of driving periods in the frame period TF2 or other frame periods is not limited to the illustrated diagram. It should be noted that, although the electronic unit 100(1, 1) in the diagram shows the driving period of one frame period TF1, after completing the process in the frame period TF1, the electronic unit 100(1, 1) may perform the process in another frame period TF1, and so on. The electronic units 100 (2, 1) to 100 (M, 1) are similar, so the description will not be repeated.

Figure 4:
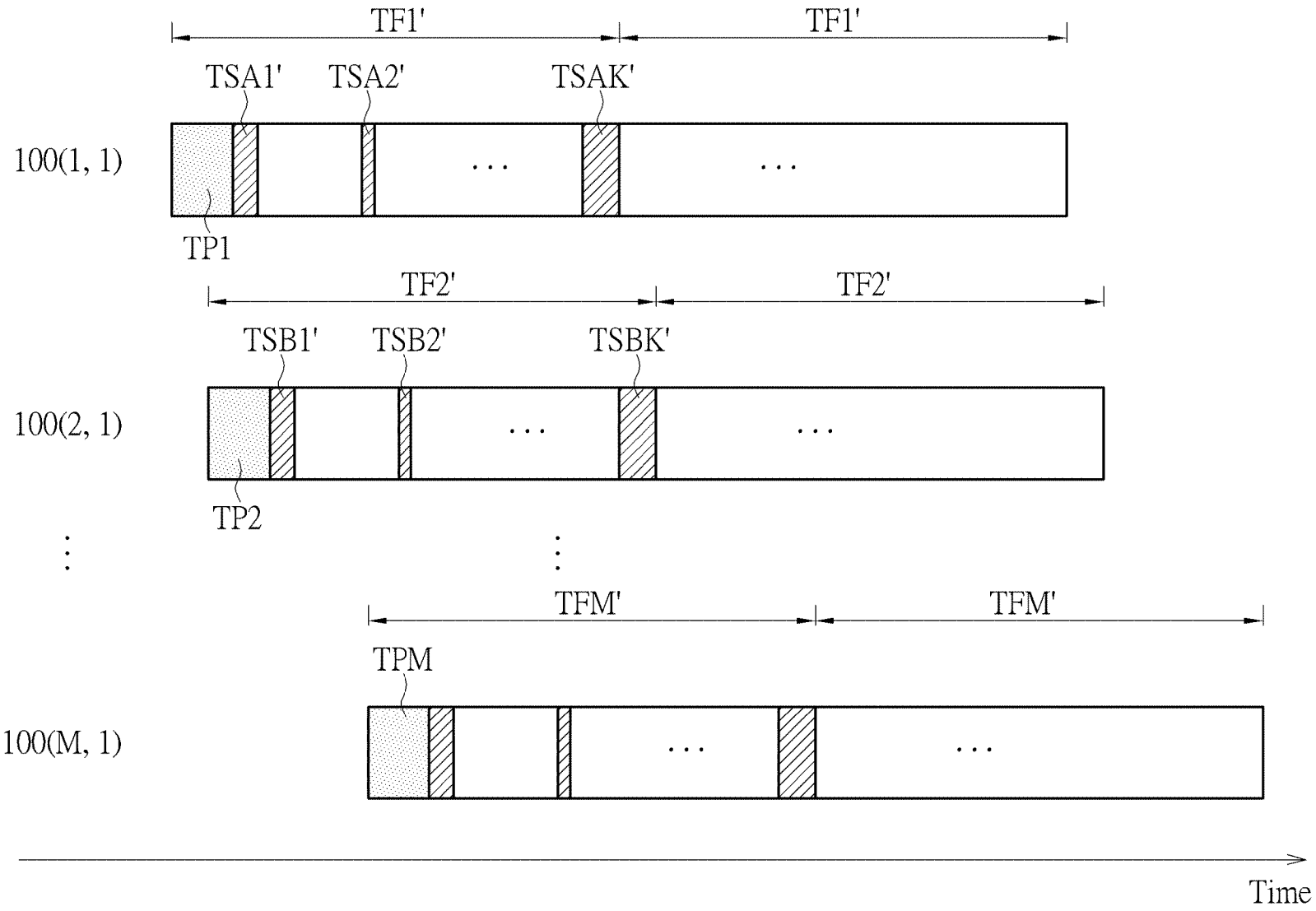
FIG. 4 shows another operation sequence of the first column of electronic units of the electronic device in FIG. 1.

FIG. 4 shows another operation sequence of the electronic units 100(1, 1) to 100(M, 1) of the electronic device 10. In FIG. 4, time intervals of driving periods TSA1', TSA2', and TSAK' in a frame period TF1' may be different in the electronic unit 100(1, 1). Similarly, time intervals of driving periods TSB1', TSB2', and TSBK' in a frame period TF2' are different in the electronic unit 100(2, 1), and so on. In the electronic unit 100 (M, 1), time intervals of the plurality of driving periods in a frame period TFM' are different, but are not limited thereto. In some embodiments, the time interval of the driving period in the frame period of at least one row of electronic units may be the same as the time interval of the driving period in the frame period of the electronic units corresponding to another row. In some embodiments, the time interval of the driving period in the frame period of electronic units corresponding to at least one row may be different from the time interval of the driving period in the frame period of the electronic units corresponding to another row. The electronic units located in different row can have different driving modes according to the requirements, such as the time interval of each driving period in one frame period and/or the number of driving periods in the frame period, but not limited thereto. For example, in the frame period TF1' of the electronic unit 100 (1, 1) corresponding to the first row, the driving periods TSA1', TSA2', and TSAK' may have different time intervals, but in the frame period TF2' of the electronic unit 100 (2, 1) corresponding to the second row, the driving periods TSB1', TSB2', and TSBK' may have equal time intervals.

Figure 5:
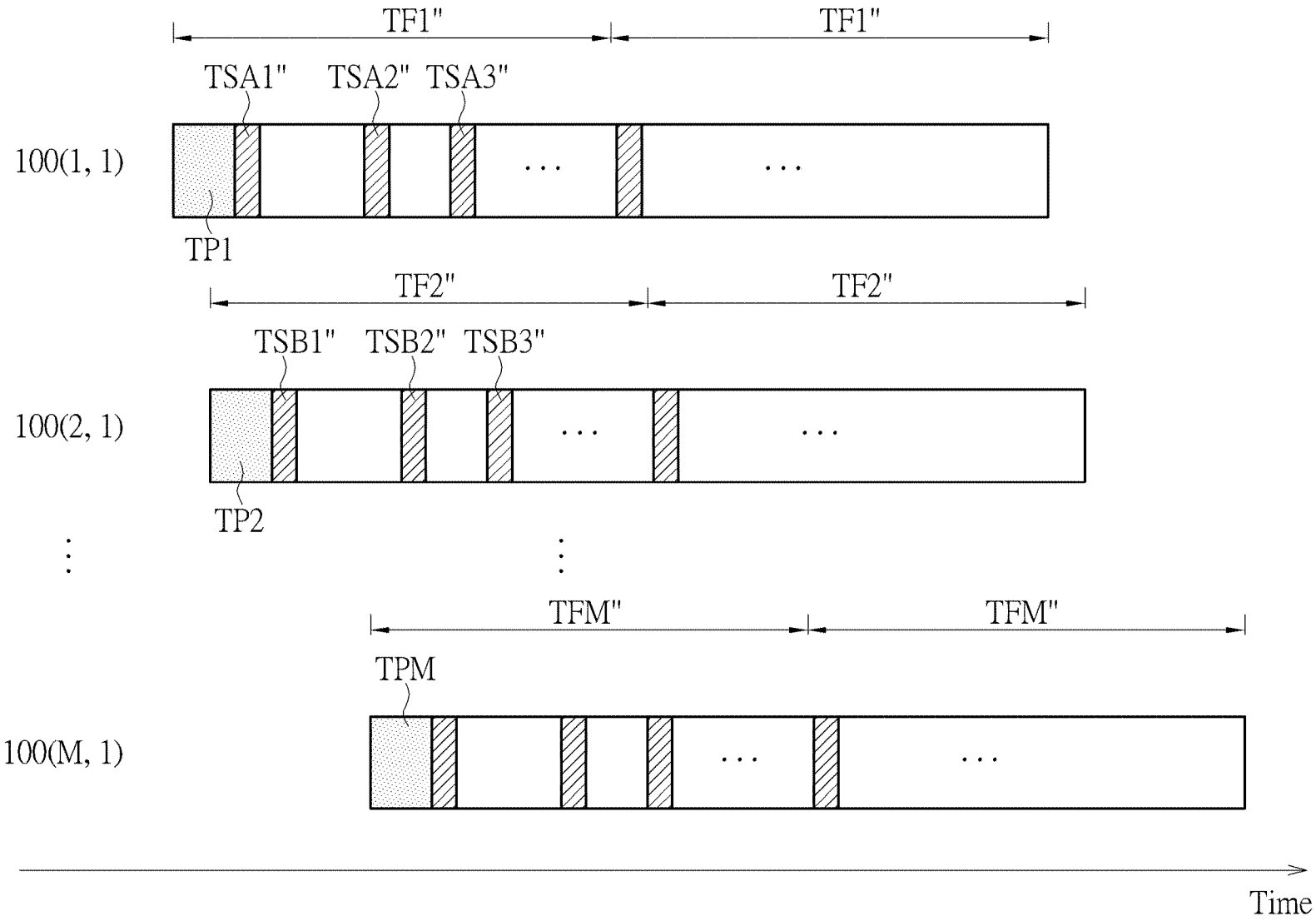
FIG. 5 shows another operation sequence of the first column of electronic units of the electronic device in FIG. 1.

FIG. 5 shows another operation sequence of the electronic units 100(1, 1) to 100(M, 1) of the electronic device 10. In FIG. 5, a time interval between a driving period TSA1" and a driving period TSA2" in a frame period TF1" of the electronic unit 100(1, 1) are different from a time interval between the driving period TSA2" and a driving period TSA3". Similarly, a time interval between the driving period TSB1" and the driving period TSB2" in a frame period TF2" of the electronic unit 100(2, 1) are different from a time interval between the driving period TSB2" and the driving period TSB3", and so on. In a frame period TFM" of the electronic unit 100(M, 1), the time interval between the two adjacent driving periods are different from the time interval of another two adjacent drive periods, but not limited thereto. In some embodiments, the time interval between the driving period TSA1" and the driving period TSA2" in the frame period TF1" of the electronic unit 100(1, 1) in the first row are different from the time interval between the driving period TSA2" and the driving period TSA3". But, the time interval between the driving period TSB1" and the driving period TSB2" in the frame period TF2" of the electronic unit 100(2, 1) in the second row may be equal to the time interval between the driving period TSB2" and the driving period TSB3".

The electronic device 10 can adjust the current amount by adjusting the sum of time intervals of the driving periods in one frame period. By this way, the LEDs in the electronic unit can emit a light with corresponding brightness. Here, the ratio of the sum of time intervals of the driving periods in one frame period to the time interval of the frame period may be defined as the duty ratio. In some embodiments, the duty ratio of the electronic unit can be designed to be less than 1. In some embodiments, the duty ratio of the electronic unit can be designed to be less than or equal to ½. In some embodiments, the duty ratio of the electronic unit can be designed to be less than or equal to ¼. In some embodiments, the duty ratio of the electronic unit can be designed to be less than or equal to ⅛. In some embodiments, the duty ratio of the electronic unit can be designed to be less than or equal to 1/16.

Figure 6:
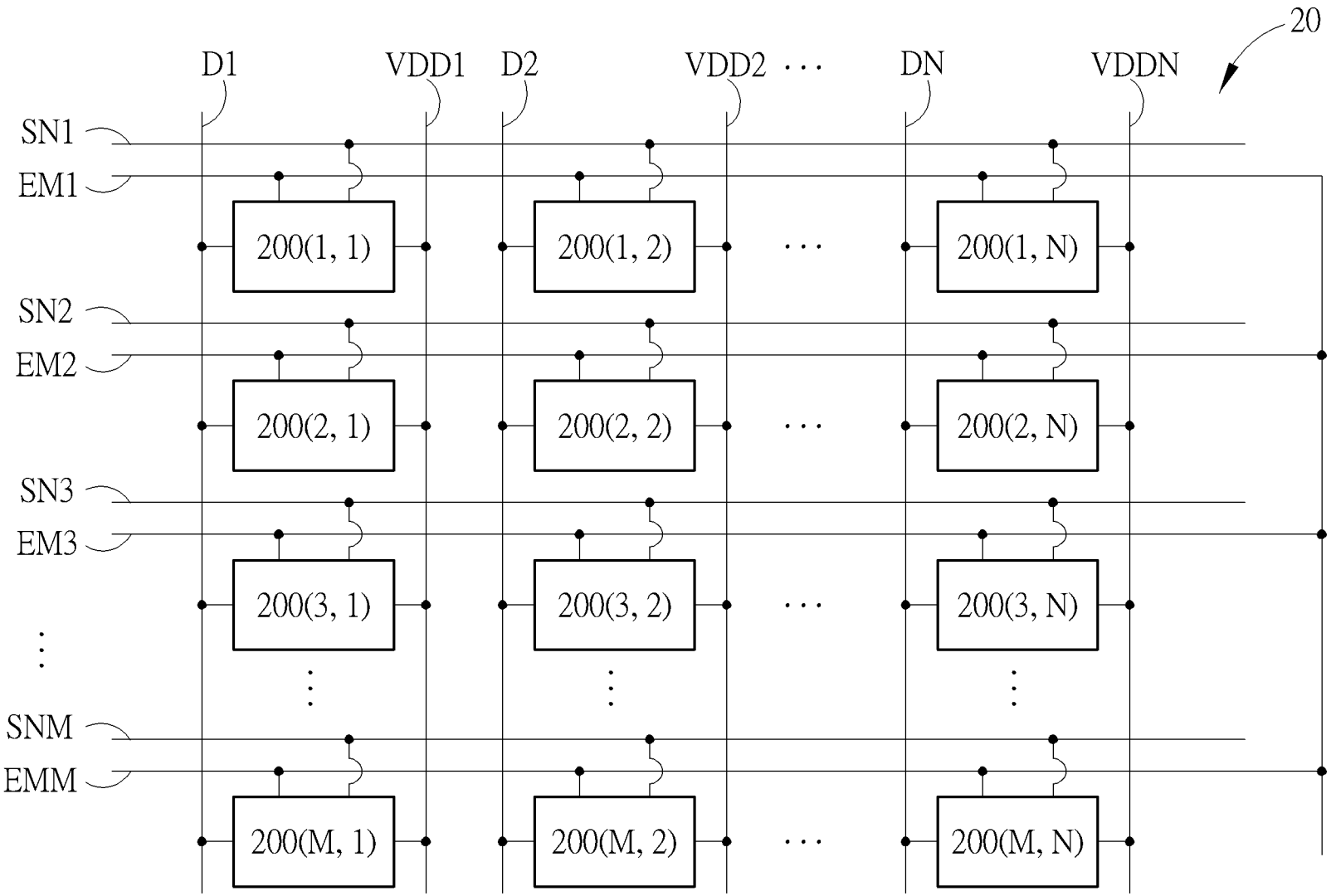
FIG. 6 is a diagram of an electronic device according to another embodiment of the present disclosure.

FIG. 6 is a diagram of an electronic device 20 according to another embodiment. The electronic device 20 and the electronic device 10 may have similar circuit configurations. The electronic device 20 may include a plurality of electronic units 200(1, 1) to 200(M, N), wherein M and N are positive integers. In some embodiments, the electronic units 200(1, 1) to 200(M, N) may be arranged in an array. In FIG. 6, the electronic units 200(1, 1) to 200(1, N) may be arranged in the same row, while electronic units 200(1, 1) to 200(M, 1) may be arranged in the same column. The electronic device 20 can sequentially turn on the electronic units corresponding to different rows. For example, the electronic device 20 can sequentially turn on electronic units corresponding to the first row to the Mth row, similar to the electronic device 10. So, the description will not be repeated here.

The difference between the electronic device 20 of FIG. 6 and the electronic device 10 of FIG. 1 is that the emission control line EM1 to the emission control line EMM in the electronic device 20 are coupled to the same control terminal. The control terminal may include a Gate on Panel (GOP) or an integrated circuit (IC). In some embodiments, the emission control line EM1 to the emission control line EMM of the electronic device 10 in FIG. 1 are not coupled to each other, and the emission control lines are coupled to different control terminals, but not limited thereto. In some embodiments, part of the emission control lines (such as the emission control line EM1 to the emission control line EMM) are coupled, and other part are coupled. So the emission control lines are separated to different parts (equal to or greater than two parts). The different parts of the emission control lines may be coupled to different control terminals.

In some embodiments, the control terminal is disposed on a circuit board. The circuit board is coupled to a substrate, and the aforementioned electronic unit, scan line, data line or other components are disposed on the substrate, but not limited thereto. The circuit board may be a flexible circuit board or a printed circuit board, but it not limited thereto. In some embodiments, the control terminal, the electronic unit, the scan line, the data line, or other components are disposed on the same substrate, and the control terminal may include a GOP. The material of the substrate may include glass, quartz, organic polymer or metal. The organic polymer may include polyimide (PI), polyethylene terephthalate (PET), polycarbonate (PC), but not limited thereto. The substrate may be an array or a chip on film (COF).

In some embodiments, the electronic units 200(1, 1) to 200(M, N) may have similar circuit configurations, but it not limited thereto. The circuit configuration may be similar to the electronic unit 100(1, 1) in FIG. 2 or similar to the electronic unit 200(1, 1) in FIG. 7, but not limited thereto. The electronic unit 200(1, 1) in FIG. 7 will be described in detail in the subsequent paragraphs.

Figure 7:
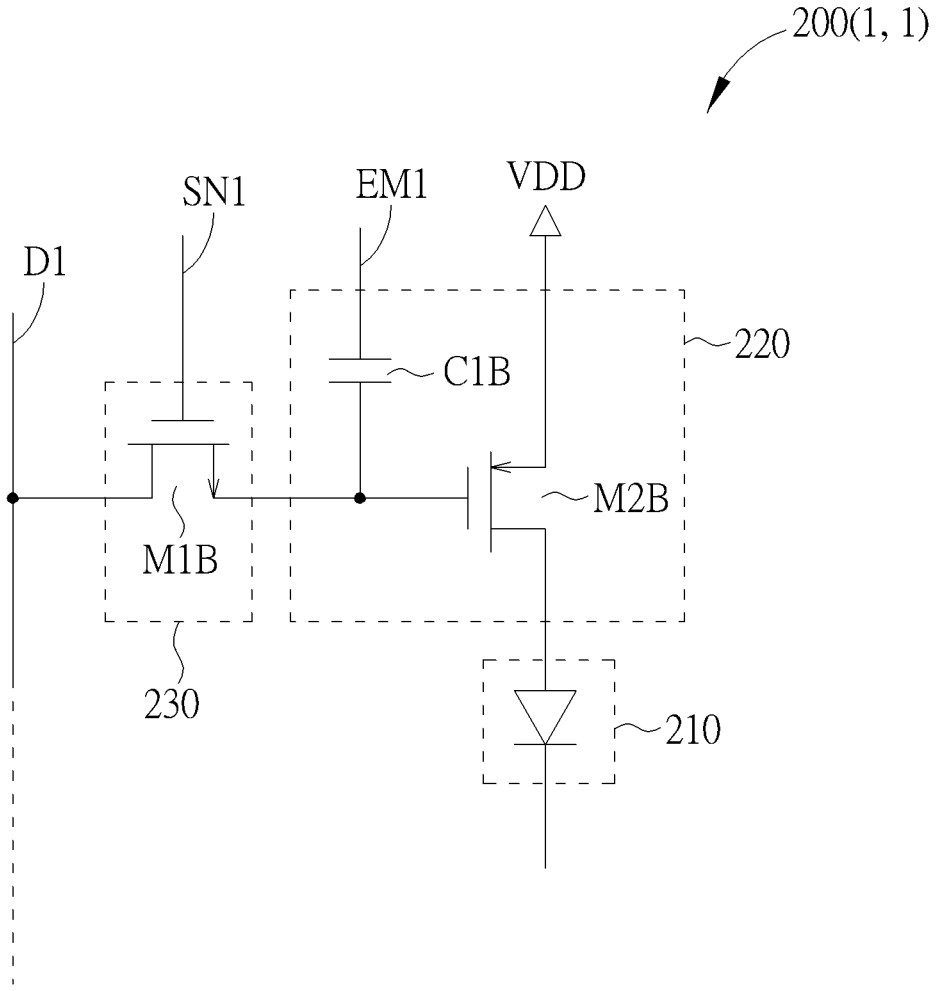
FIG. 7 is a circuit diagram of an electronic unit of the electronic device in FIG. 6.

The aforementioned electronic units 200 (1, 1) to 200 (M, N) have similar circuit configurations, meaning the number of switch units, driving units, LEDs or other components in the electronic units are the same. But the size (or stacking configuration) of the switch units, driving units, LEDs or other components need not to be the same. The circuit diagrams of the electronic unit 100(1, 1) in FIG. 2 or the electronic unit 200(1, 1) in FIG. 7 are merely simple illustrations of the components or circuits that are basically required, but the disclosure is not limited thereto. In other embodiments, the circuit configuration of the electronic units may be added with other components, such as other transistors or other components. The added components may be coupled to either terminal of the existing components in the electronic units in the embodiments.

In some embodiments, the circuit configuration or stacking configuration of electronic units 100(1, 1) to 100(M, N) in FIG. 1 may be similar or not similar. For example, the electronic units 100(1, 1) to 100(M, N) may emit light with different colors (including red, blue, green, or other colors). So the materials or the stacking configuration of some layers or elements of the electronic units may be different. For example, LED chips or luminescent materials used for different electronic units may be different. Similarly, the circuit configuration or the stacking structure of the electronic units 200(1, 1) to 200(M, N) may be similar or not similar. The description will not be repeated here.

FIG. 7 is a circuit diagram of an electronic unit 200(1, 1) of the electronic device 20. In FIG. 7, the electronic unit 200(1, 1) may comprise an LED 210, a driving unit 220 and a switch unit 230. The driving unit 220 may be coupled to the LED 210, and the switch unit 230 may be coupled to the driving unit 220. In one frame period, the electronic unit 200(1, 1) performs a step of storage the data voltage. For example, when the switch unit 230 of the electronic unit 200(1, 1) is turned on, the driving unit 220 receives a data voltage transmitted by the data line D1 through the switch unit 230. The data voltage may be stored in a capacitor C1B of the driving unit 220. Subsequently, the driving unit 220 can generate the corresponding amount of current according to the data voltage to drive the LED 210, so that the LED 210 emits light with corresponding brightness.

The difference between FIG. 7 and FIG. 2 is that the driving unit 220 does not include the transistor M3A (the control transistor). In detail, the switch unit 230 in the electronic unit 200(1, 1) in FIG. 7 may include the transistor M1B (the switch transistor). The driving unit 220 may include the transistor M2B (the driving transistor) and the capacitor C1B. One terminal of the capacitor C1B is coupled to the emission control line EM1. The transistor M1B is coupled to the scan line SN1 and the data line D1. During step of storage the data voltage, a scan voltage is transmitted through the scan line SN1 to turn on the transistor M1B. At this time, the data line D1 transmits a data voltage to the capacitor C1B, the data voltage can store, in the subsequent driving period, the transistor M2B may drive the LED 210 by generating a corresponding amount of current according to the data voltage. Since one terminal of the capacitor C1B is coupled to the emission control line EM1, it can determine whether the transistor M2B is turned on. The transistor M2B is turned on during the driving period and turned off during other times such as the time interval between two adjacent driving periods, thereby controlling the sum of the time internals of the driving period or the duty ratio. It should be noted that, the circuit diagram of the electronic unit 200(1, 1) of FIG. 7 is merely illustrative, and the electronic unit 200(1, 1) may include other transistors, capacitors or other suitable components.

Figure 8:
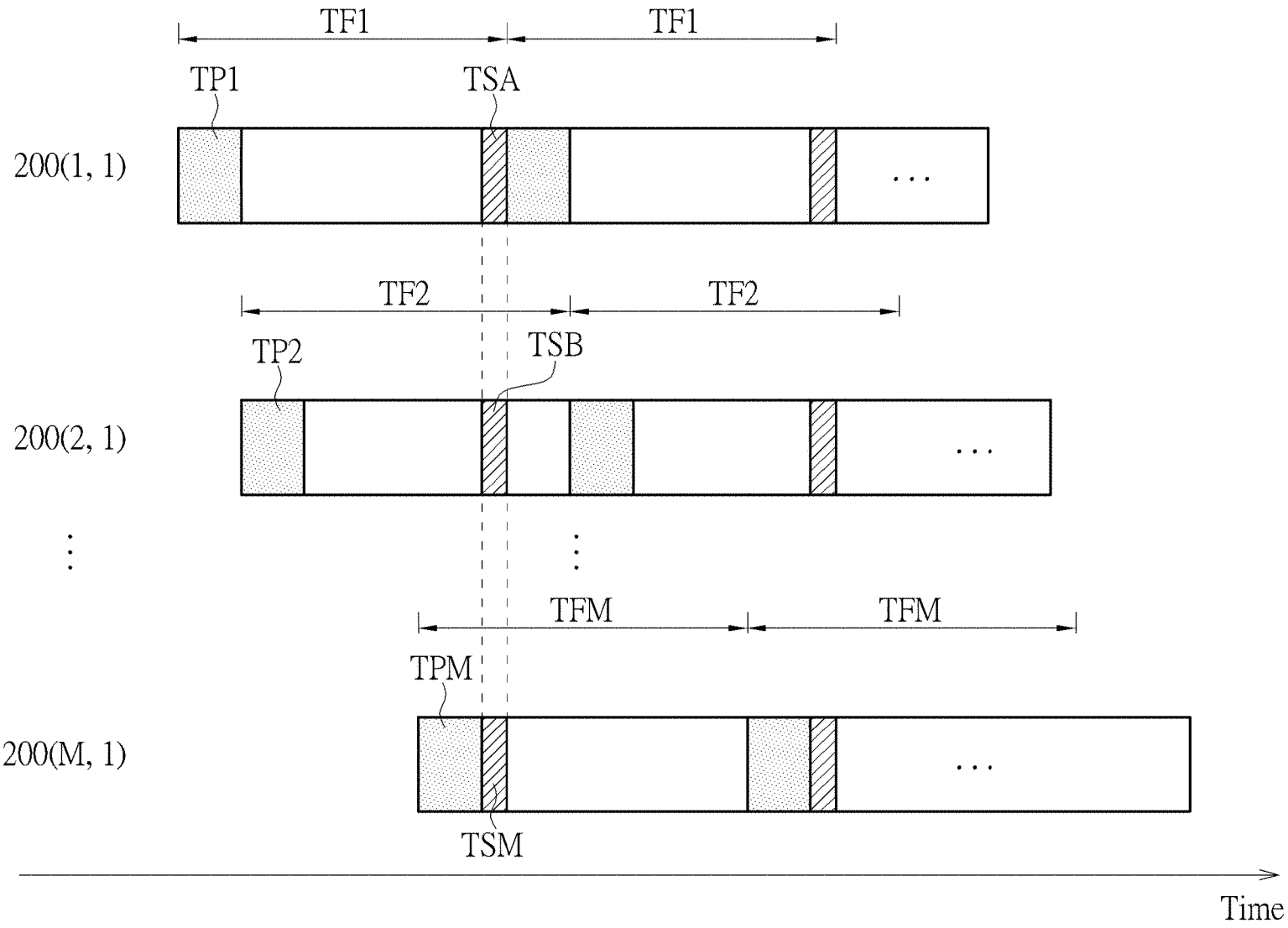
FIG. 8 shows an operation sequence of the first column of electronic units of the electronic device in FIG. 6.

FIG. 8 shows an operation sequence of the electronic units 200 (1, 1) to 200(M, 1) of the electronic device 20. In FIG. 8, the electronic units 200(1, 1) to 200 (M, 1) in the first column perform data storage at time periods TP1 to TPM respectively. After the electronic unit 200(1, 1) obtains a data voltage in the time period TP1 in a frame period TF1 of the electronic unit 200(1, 1), a current is generated to drive the LED 210 according to a data voltage in a subsequent driving period TSA. Similarly, the electronic unit 200(2, 1) drives the LED 210 in a driving period TSB after the step of storage the data voltage is completed in a period TP2 in a frame period TF2. The frame period TF1 and the frame period TF2 correspond to the same picture frame, and the time interval of the frame period TF1 is generally equal to the time interval of the frame period TF2. In FIG. 8, the starting time of the driving period TSB in the frame period TF2 is generally equal to the starting time of the driving period TSA in the frame period TF1, and so on. So, the starting time of the driving period TSM in the frame period TFM is generally equal to the starting time of the drive period TSA in the frame period TF1. In other embodiments, the ending time of the driving period TSA and the ending time of the driving period TSB may be generally equal, but not limited thereto. In some embodiments, the starting time of the drive period TSM in the frame period TFM is generally equal to the starting time of the driving period TSA in the frame period TF1, but the ending time of the driving period TSA and the ending time of the driving period TSB may be different. In FIG. 8, although the electronic units 200(1, 1) to 200(M, 1) respectively perform data storage in different time periods TP1 to TPM, the electronic units 200(1, 1) to 200(M, 1) may drive the LEDs 210 to emit light at the same starting time. In this case, since the starting time of the driving periods of the electronic units disposed in different rows are the same, the LEDs in the electronic units can emit light simultaneously. The aforementioned "simultaneously" may be defined as a time difference of about less than 10 μs, but not limited thereto. In addition, "simultaneously" may be explained using other embodiments. The electronic units of the same row are coupled to the same voltage signal line. For example, the electronic units 200(1, 1) to 200(M, 1) in FIG. 6 are coupled to a voltage signal line VDD1. When the voltage signal line VDD1 transmits a voltage, it can be received by the electronic units 200(1, 1) to 200(M, 1) simultaneously.

In FIG. 8, since the driving periods (including the starting time and/or the ending time) in the frame period of the electronic units corresponding to different rows are the same, the time interval between the two adjacent driving periods of such design (for example, 200(1.1)) may be greater than the time interval between the two adjacent driving periods for the embodiment in FIG. 3. In some embodiments, in order to reduce flickering, the frame rate of the electronic unit can be increased to be equal to or greater than 60 Hz. In some embodiments, the frame rate can be equal to or greater than 120 Hz, but not limited thereto.

As shown in FIG. 8, the time interval of the driving period TSA in the frame period TF1 is less than the time interval of the frame period TF1. The time interval of the driving period TSB in the frame period TF2 is less than the time interval of the frame period TF2. By the aforementioned design, the amount of driving current of the LED 210 can be increased to reduce color shift, to increase the luminous efficacy and to reduce the power loss.

Figure 9:
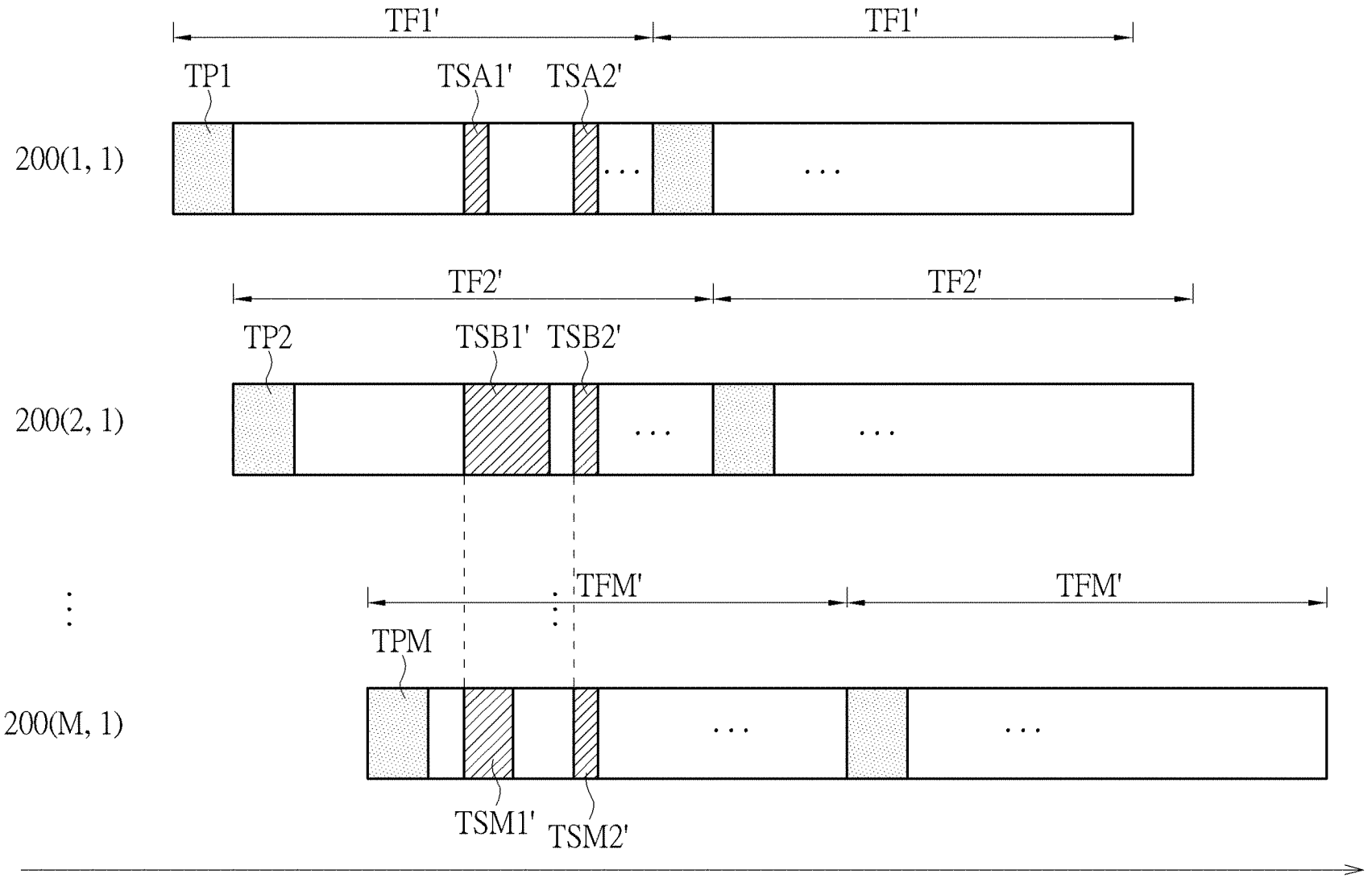
FIG. 9 shows another operation sequence of the first column of electronic units of the electronic device in FIG. 6.

FIG. 9 shows another operation sequence of the electronic units 200(1, 1) to 200(M, 1) of the electronic device 20. In FIG. 9, two driving periods, a driving period TSA1' and a driving period TSA2', may be included in a frame period TF1'. A driving period TSB1' and a driving period TSB2' may be included in the frame period TF2', and so on. Two driving periods may also be included in a frame period TFM'. For example, the driving period TSM1' and the driving period TSM2', but not limited thereto. As shown in FIG. 9, the driving period TSA1', the driving period TSB1' and the driving period TSM1' have generally the same starting time, but the driving period TSA1', the driving period TSB1' and the driving period TSM1' have generally different ending times. The driving period TSA2', the driving period TSB2' and the driving period TSM2' have the same starting time, but the driving time period TSA1', the driving time period TSB1' and the driving time period TSM2' have the same ending time, but not limited thereto.

In order to observe whether the driving method of the electronic device is similar to the embodiments provided, a user can use a display panel to display a picture and use a photo sensor corresponding to the electronic units to obtain the time intervals of driving periods, the number of driving periods in one frame period, the time interval between two adjacent driving periods, the duty ratio . . . etc. The driving method between the electronic units of different columns can be obtained by this way.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An electronic device, comprising:

a first electronic unit comprising:

a first light emitting diode; and a first driving unit, coupled to the first light emitting diode and configured to received a first data voltage;

wherein the first electronic unit has a plurality of driving periods in a first frame period, and the first driving unit drives the first light emitting diode according to the first data voltage at the plurality of driving periods;

wherein a sum of time intervals of the plurality of the driving periods in the first frame period is less than a time interval of the first frame period; and wherein a ratio of the sum of time intervals of the plurality of the driving periods in the first frame period to the time interval of the first frame period is less than or equal to ½.

2. The electronic device of claim 1, wherein the plurality of driving periods in the first frame period have the same time intervals.

3. The electronic device of claim 1, wherein at least two of driving periods of the plurality of driving periods in the first frame period have different time intervals.

4. The electronic device of claim 1, wherein a time interval between two adjacent ones of the plurality of driving periods is the same as a time interval between another two adjacent ones of the plurality of driving periods in the first frame period.

5. The electronic device of claim 1, wherein a time interval between two adjacent ones of the plurality of driving periods is different from a time interval between another two adjacent ones of the plurality of driving periods in the first frame period.

6. The electronic device of claim 1 further comprising a second electronic unit, the second electronic unit comprising:

a second light emitting diode; and a second driving unit coupled to the second light emitting diode and configured to receive a second data voltage;

wherein the second electronic unit has a plurality of driving periods in a second frame period, and the second driving unit drives the second light emitting diode according to the second data voltage in the plurality of driving periods in the second frame period.

7. The electronic device of claim 6, wherein a sum of time intervals of the plurality of driving periods in the first frame period is different from a sum of time intervals of the plurality of driving periods in the second frame period.

8. The electronic device of claim 6, wherein a number of transistors in the first driving unit is different from a number of transistors in the second driving unit.

9. The electronic device of claim 1, further comprising an emission control line coupled to the first light emitting diode, wherein the emission control line is coupled to a control terminal.

10. The electronic device of claim 9, wherein the control terminal includes a gate on panel or an integrated circuit.

11. An electronic device, comprising:

a first electronic unit comprising:

a first light emitting diode; and a first driving unit coupled to the first light emitting diode and configured to receive a first data voltage; and a second electronic unit comprising:

a second light emitting diode; and a second driving unit coupled to the second light emitting diode and configured to received a second data voltage;

wherein the first electronic unit has at least one driving period in a first frame period, and the first driving unit drives the first light emitting diode according to the first data voltage in the at least one driving period in the first frame period;

wherein the second electronic unit has at least one driving period in a second frame period, and the second driving unit drives the second light emitting diode according to the second data voltage in the at least one driving period in the second frame period;

wherein a starting time of the first driving unit receiving the first data voltage is different from a starting time of the second driving unit receiving the second data voltage, and a starting time of the at least one driving period in the first frame period is same as a starting time of the at least one driving period in the second frame period; and wherein the first frame period and the second frame period are configured to display a same picture frame.

12. The electronic device of claim 11, wherein a sum of time interval of the at least one driving period in the first frame period is less than a time interval of the first frame period, and a sum of at least one time interval of the at least one driving period in the second frame period is less than a time interval of the second frame period.

13. The electronic device of claim 11, wherein a sum of at least one time interval of the at least one driving period in the first frame period is different from a sum of at least one time interval of the at least one driving period in the second frame period.

14. The electronic device of claim 13, wherein a ratio of the sum of at least one time interval of the at least one driving period in the first frame period to the time interval of the frame period is less than or equal to ½.

15. The electronic device of claim 11, wherein a number of transistors in the first driving unit is different from a number of transistors in the second driving unit.

16. The electronic device of claim 11, further comprising an emission control line coupled to the first light emitting diode, wherein the emission control line is coupled to a first control terminal.

17. The electronic device of claim 16, wherein the control terminal include a gate on panel or an integrated circuit.

18. The electronic device of claim 16, further comprising an emission control line coupled to the second light emitting diode, wherein the emission control line coupled to the second light emitting diode is coupled to the first control terminal.

* * * * *